US009772171B2

(12) United States Patent
Henry, III

(10) Patent No.: US 9,772,171 B2
(45) Date of Patent: Sep. 26, 2017

(54) METHOD OF MODIFYING AMMUNITION CLASSIFICATION

(71) Applicant: Patrick C Henry, III, Myrtle Beach, SC (US)

(72) Inventor: Patrick C Henry, III, Myrtle Beach, SC (US)

( * ) Notice: Subject to any disclaimer, the term of this patent is extended or adjusted under 35 U.S.C. 154(b) by 0 days.

(21) Appl. No.: 15/077,614

(22) Filed: Mar. 22, 2016

(65) Prior Publication Data

US 2016/0282097 A1 Sep. 29, 2016

Related U.S. Application Data

(60) Provisional application No. 62/137,306, filed on Mar. 24, 2015.

(51) Int. Cl.

| | |
|---|---|
| ***F42B 33/00*** | (2006.01) |
| ***F42B 12/74*** | (2006.01) |
| *F42B 12/06* | (2006.01) |
| *F42B 12/04* | (2006.01) |

(52) U.S. Cl.

CPC ..... *F42B 33/00* (2013.01); *F42B 12/74* (2013.01); *F42B 12/04* (2013.01); *F42B 12/06* (2013.01)

(58) Field of Classification Search

CPC ..... F42B 12/04; F42B 12/74; F42B 33/00–33/14; F42B 12/06

See application file for complete search history.

(56) References Cited

U.S. PATENT DOCUMENTS

| | | | | |
|---|---|---|---|---|
| 4,256,039 | A * | 3/1981 | Gilman | F42B 12/74 102/517 |
| 7,455,015 | B2 * | 11/2008 | Krstic | F42B 12/74 102/439 |
| 7,661,368 | B2 * | 2/2010 | Riess | F42B 12/38 102/501 |
| 7,770,521 | B2 * | 8/2010 | Williams | F42B 12/22 102/364 |
| 8,074,574 | B2 * | 12/2011 | Riess | F42B 12/06 102/518 |
| 2002/0059882 | A1 * | 5/2002 | Begg | C22C 27/04 102/518 |

FOREIGN PATENT DOCUMENTS

| | | | | |
|---|---|---|---|---|
| CH | EP 1156297 | A1 * | 11/2001 | F42B 12/34 |

* cited by examiner

*Primary Examiner* — Stephen M Johnson
*Assistant Examiner* — Joshua Semick
(74) *Attorney, Agent, or Firm* — Baker, Donelson, Bearman, Caldwell & Berkowitz, PC; Dorian Kennedy

(57) ABSTRACT

A method is disclosed for modifying pre-existing ammunition projectile (10) which includes a hard metal inner core (11). The projectile is secured and a drill is applied to the tip end (17) of the projectile so as to create a bore (20) extending into the core. An insert (22) is then coupled to the projectile. The insert may include a shaft portion (23) which extends into the core channel and a tip portion (25). The insert is made of a non-hard metal or soft material.

12 Claims, 3 Drawing Sheets

METHOD OF MODIFYING AMMUNITION CLASSIFICATION

REFERENCE TO RELATED APPLICATION

Applicant claims the benefit of U.S. Provisional Patent Application Ser. No. 62/137,306 filed Mar. 24, 2015.

TECHNICAL FIELD

This invention relates generally to modifying ammunition classification.

BACKGROUND OF THE INVENTION

Ammunition used in connection with firearms such as rifles, pistols, and the like has been used for centuries. Much of today's ammunition includes a cartridge or casing which houses the gunpowder and a primer which ignites the gunpowder upon actuation of the firearm. A bullet or projectile is coupled to the casing which is expelled from the firearm upon discharge.

Today's regulations place restrictions on the type of bullet or projectile which may be associated with certain types of firearms. One such regulation relates to projectile or specifically to the projectile core which some may term armor piercing ammunition if certain physical criteria exists. The regulation states that the projectile or projectile core cannot be constructed entirely from certain types of hard or hardened metals, such as tungsten alloys, steel, iron, brass, bronze, beryllium copper, or depleted uranium. As such, this type of ammunition cannot be imported into or manufactured within the United States of America even though they may exist in other parts of the world. Hard metals do not include metals which are considered to be soft metals, such as copper, lead, or the like.

Accordingly, it is seen that a need remains for a method of converting or redesigning such illegal/restricted (only saleable to law enforcement or the military) ammunition to ammunition that is legally sellable to the general public within the United States of America or other jurisdictions which restrict the sale of such ammunition. It is to the provision of such therefore that the present invention is primarily directed.

DETAILED DESCRIPTION

Figure 1:
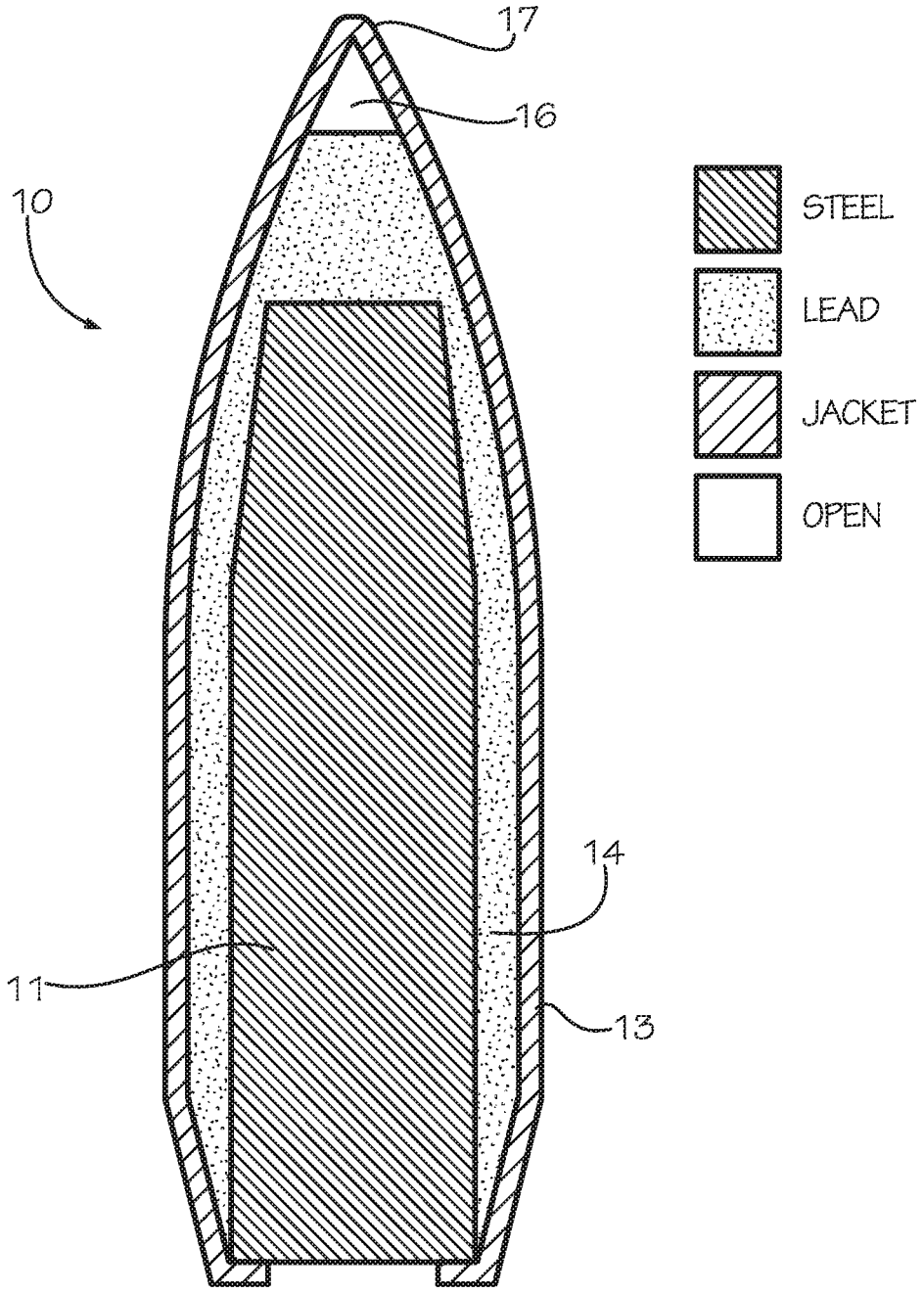
FIG. 1 is a cross-sectional view of a pre-modification ammunition.

With reference next to the drawings, there is shown in FIG. 1 an unmodified, pre-existing ammunition slug or projectile 10 which is currently considered illegal within the United States of America as it is considered to be an armor piercing ammunition projectile since it includes a projectile core 11 constructed entirely from a hard metal. The projectile is coupled to a casing C which houses a gunpowder load. The projectile 10 includes a metal jacket 13 as the outermost layer and a lead layer 14 position between the metal jacket 13 and the inner core 11. The projectile may or may not also include a small open area, void, or air gap 16 at the tip end 17 of the projectile. The restricted core 11 is made of a hard metal such as tungsten alloys, steel, iron, brass, bronze, beryllium copper, or depleted uranium. The jacket may be made of any soft metal such as copper, copper clad steel, or other suitable materials. The lead layer 14, sometimes referred to as a liner, also may be made of a soft metals or other suitable non-metal materials.

As used herein, a hard metal is a metal which forms a hard metal core as defined under the current law, 18 U.S.C §921, for "armor piercing ammunition", which is defined as a projectile or projectile core which may be used in a handgun and which is constructed entirely (excluding the presence of traces of other substances) from one or a combination of tungsten alloys, steel, iron, brass, bronze, beryllium copper, or depleted uranium (hard metals). A second definition of "hard metal core", added to the law in the 1990s, includes a definition as a full jacketed projectile larger than .22 caliber designed and intended for use in a handgun and whose jacket has a weight of more than 25 percent of the total weight of the projectile. A soft metal or soft material insert as used herein is a material which is softer than the hard metal material defined herein and therefore not included in the current law.

Figure 3:
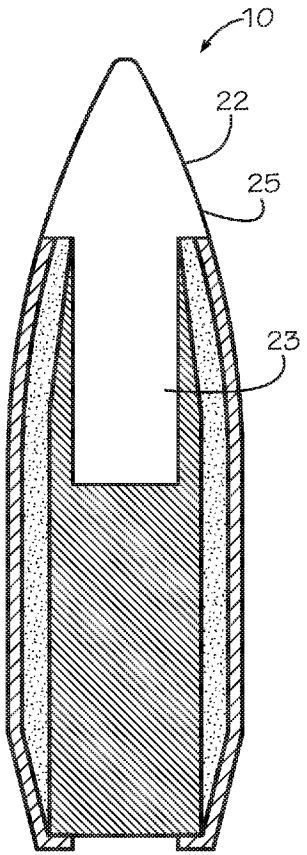
FIG. 3 is a cross-sectional view of the ammunition of FIG. 1 upon completion of the ammunition modification process of the present invention.
Figure 2:
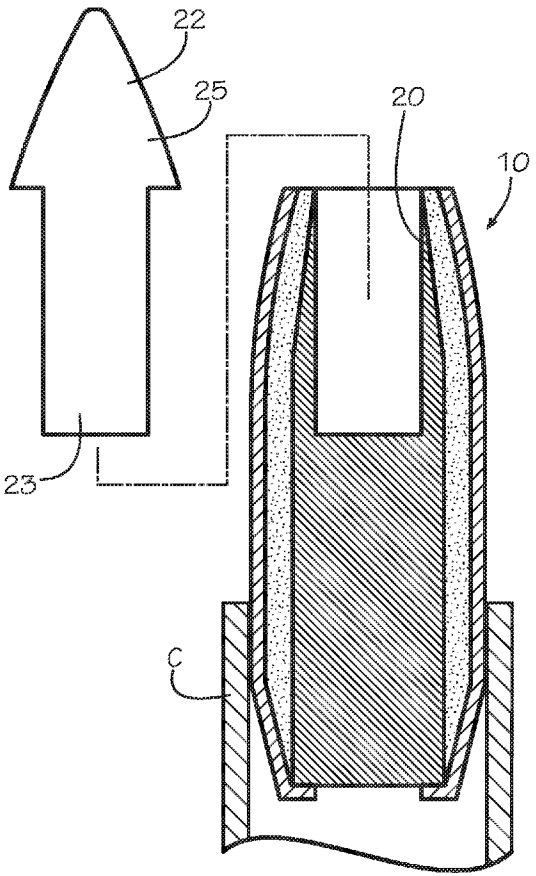
FIG. 2 is a cross-sectional view of the ammunition of FIG. 1 partially through the ammunition modification process of the present invention.

In order to modify the projectile core of FIG. 1 to a projectile which conforms with non-restricted/allowable ammunition under today's regulations the following method or process is utilized. The projectile 10 is secured to prevent movement through the use of a clamping mechanism, placement within a confining structure, or other device, so that a drill may be applied to the projectile. Alternatively, the projectile is rotated relative to a stationary drill or drill bit. A drill is then applied to the tip end 17 of the projectile so as to remove the tip end and create a void, bore, or channel 20 extending into the core 11, as shown in FIG. 2. A substitute tip or insert 22 is then coupled to the projectile 10. The insert 22 includes a shaft portion 23 which extends into the core channel 20 and a tip portion 25 external of the channel 20 which conforms to the shape of the remaining projectile to form a projectile tip, as shown in FIG. 3.

The insert 22 is made of a non-hard metal or soft material such as lead, aluminum, a polymer, wood, paper, or other suitable material. The insert may be press fitted into the bore or positioned and maintained in place through a friction fit, adhesive, threads, detents, or other type of coupling method or device.

It should be understood that the amount of core material removed by the drilling process may be varied according to the current law, type of ammunition and/or caliber of ammunition. For example, the amount of material removed may be relatively small, for example 5% to 30% by weight of the core, or medium, for example 30% to 50% by weight, or large, meaning over 50% by weight removed. The amount of removed material may be dependent upon the regulations in place at the time in order to achieve a legal or conforming status for the ammunition.

After the modification method is complete, the newly modified form of the projectile exists wherein the projectile does not include a core which is constructed entirely from a hard metal, as the core 11 includes the soft material insert 22. Therefore, the newly modified projectile is allowable by law to be sold to the public.

Figure 4:
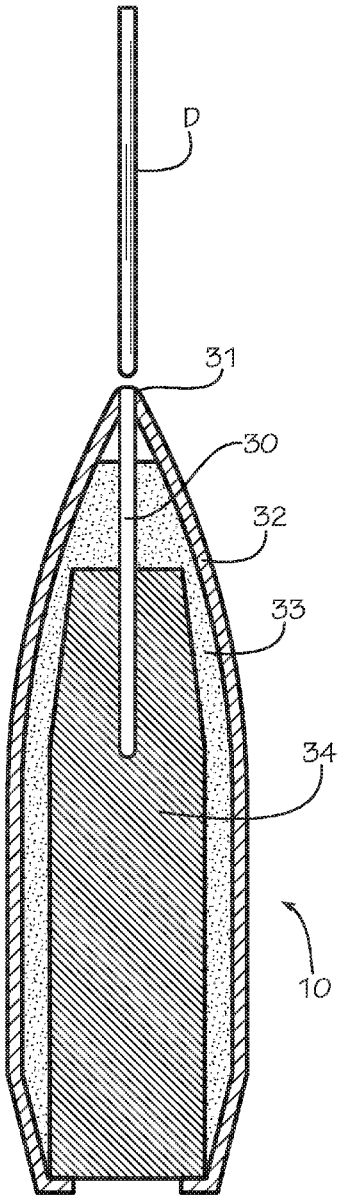
FIG. 4 is a cross-sectional view of the ammunition of FIG. 1 partially through a second preferred form of the ammunition modification process of the present invention.
Figure 5:
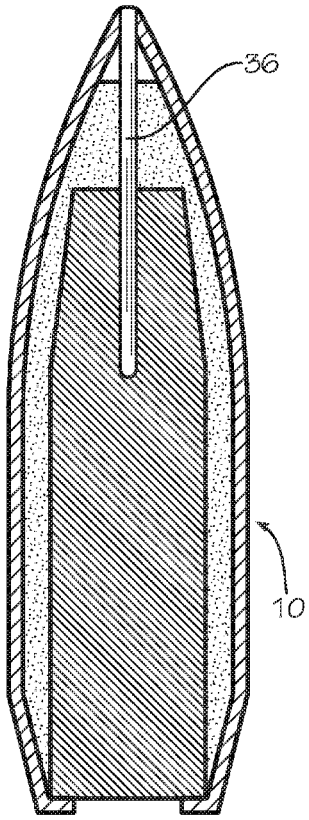
FIG. 5 is a cross-sectional view of the ammunition of FIG. 4 upon completion of the ammunition modification process of the present invention.

As an alternative, FIGS. 4 and 5 show a second method of modifying the ammunition in a preferred form of the invention. Here, a small drill D is utilized to form a single, small bore or channel 30 extending from the projectile tip 31 through the jacket 32, liner 33 and into core 34. A non-restricted, soft material rod 36 is then inserted into the bore 30 and maintained in place as previously described. Again, the soft material rod 36 may be made of any suitable soft material such as lead, aluminum, a polymer, wood, paper, or the like.

Figure 6:
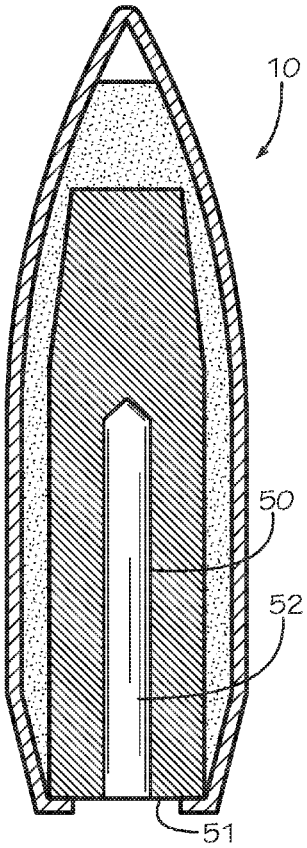
FIG. 6 is a cross-sectional view of the ammunition of FIG. 1 upon completion of a third preferred form of the ammunition modification process of the present invention.

As yet another alternative, shown in FIG. 6, the projectile is shown wherein a bore 50 is drilled into the base or bottom 51 of the projectile rather than through the tip of the projectile. Again, a soft material rod 52 is inserted into the bore 50 and maintained in place as previously described.

The term drilling, as used herein, is intended to include other methods of removing or displacing material to form a channel, such as by or with the use of milling, electronic discharge devices, electrical burning, water jets, punch press, or the like.

It should be understood that the drawings show a projectile wherein the core is separated from the jacket by a lead layer or liner. However, the present invention is not limited to the modification of this particular design or caliber of ammunition and may be utilized with any type of ammunition regardless of the use of jackets, liners, and/or other additional layers of material.

It should be understood that the present method is with regard to pre-existing, non-conforming projectiles as opposed to projectiles which are initially manufactured to be conforming to the government regulations referenced herein. As such, the term "pre-existing" means a projectile which has been manufactured or exists as a complete and/or final product in the form of a projectile and not a projectile which is formed during an interim step of the manufacturing process prior to being finished.

Lastly, it should be understood that the projectile core may be drilled or bored in any position or location, even through the side of the projectile core, and with any number of bores, in accordance with the present invention.

It thus is seen that a method of modifying ammunition is now provided which may be utilized to convert a pre-existing, restricted type of ammunition to an acceptable or unrestricted type of ammunition that is legally sellable to the general public. While this invention has been described in detail with particular reference to the preferred embodiment thereof, it should be understood that many modification, redesign, additions and deletions, may be made thereto without departure from the spirit and scope of the invention as set forth in the following claims.

The invention claimed is:

1. A method of modifying pre-existing ammunition comprising the steps of:

(A) providing pre-existing ammunition having a shell casing and a projectile coupled to the shell casing, the projectile having a pre-existing, entirely hard metal core having a tip;

(B) forming a bore through the tip within the pre-existing, entirely hard metal core of the projectile to remove a portion of the tip, and (C) mounting a non-hard metal insert into the bore formed within the pre-existing, entirely hard metal core of the projectile to form a new tip.

2. The method of claim 1 wherein said pre-existing, entirely hard metal core of the projectile is made of a tungsten alloys, steel, iron, brass, bronze, beryllium copper, or depleted uranium material.

3. The method of claim 1 wherein said non-hard metal insert has a shaft portion sized to fit within the bore and a tip portion positioned externally of the bore.

4. The method of claim 1 wherein the bore is formed by drilling a hole within the projectile.

5. A method of modifying pre-existing ammunition comprising the steps of:

(A) providing a pre-existing ammunition projectile having a hard metal core with a tip;

(B) forming a bore through the tip within the hard metal core to remove a portion of the tip, and (C) mounting a soft material insert into the bore formed within the hard metal core to form a new tip.

6. The method of claim 5 wherein said hard metal core is made of a tungsten alloys, steel, iron, brass, bronze, beryllium copper, or depleted uranium material.

7. The method of claim 5 wherein said soft material insert has a shaft portion sized to fit within the bore and a tip portion positioned externally of the bore.

8. The method of claim 5 wherein the bore is formed by drilling a hole within the projectile.

9. A method of modifying pre-existing ammunition comprising the steps of:

(A) providing a pre-existing ammunition projectile having a hard metal core with a tip;

(B) removing a portion of the hard metal core through the tip to remove a portion of the tip to form a void, and (C) replacing the removed portion of the hard metal core with a non-hard metal material insert to form a new tip.

10. The method of claim 9 wherein said hard metal core is made of a tungsten alloys, steel, iron, brass, bronze, beryllium copper, or depleted uranium material.

11. The method of claim 9 wherein said non-hard metal material insert is in the form of an insert having a shaft portion sized to fit within the void and a tip portion positioned externally of the void.

12. The method of claim 9 wherein the void is formed by drilling a hole within the projectile.

* * * * *